United States Patent [19]

Sheldon

[11] 4,226,363

[45] Oct. 7, 1980

[54] STOVE BENCH

[76] Inventor: Dana M. Sheldon, 13 Sea St., Camden, Me. 04843

[21] Appl. No.: 843,717

[22] Filed: Oct. 20, 1977

[51] Int. Cl.[3] ..... F24B 7/04

[52] U.S. Cl. ..... 237/54; 126/285 R; 165/DIG. 2; 237/55

[58] Field of Search ..... 237/54, 55, 12.3 A; 165/DIG. 2, 40; 126/204, 285 R, 288, 289

[56] References Cited

U.S. PATENT DOCUMENTS

| | | | |
|---|---|---|---|
| 208,251 | 9/1878 | Mains | 126/204 X |
| 538,635 | 4/1895 | Anderson | 237/54 X |
| 595,018 | 12/1897 | Hemje | 237/54 X |
| 798,625 | 9/1905 | Reed | 126/204 X |
| 1,170,642 | 2/1916 | Jackson | 126/288 |
| 1,245,885 | 11/1917 | De Polo | 237/54 X |
| 1,417,987 | 5/1922 | Griffith | 237/54 X |
| 1,531,769 | 3/1925 | Vollbracht | 126/288 |
| 1,547,781 | 7/1925 | Beers | 165/DIG. 2 |
| 1,891,169 | 12/1932 | Mundorf | 165/40 |
| 3,948,246 | 4/1976 | Jenkins | 126/204 |
| 4,050,628 | 9/1977 | Konnerth | 237/55 |

FOREIGN PATENT DOCUMENTS

| | | | |
|---|---|---|---|
| 168656 | 7/1934 | Switzerland | 237/54 |
| 238653 | 11/1945 | Switzerland | 237/54 |

*Primary Examiner*—Rodney H. Bonck
*Attorney, Agent, or Firm*—Wolf, Greenfield & Sacks

[57] ABSTRACT

A stove bench comprised of a metal liner forming an interior duct which is covered with tiles or masonry to form the outer face of the stove bench, an inlet to the duct for receiving hot exhaust gases from a stove or furnace, and an outlet from the duct for the exhaust of the gases to a chimney or the like. The bench has a top that is also covered with tiles, masonry, or soapstone, permitting heat conduction thereto, and permitting the top to serve as a seating or sleeping surface. The stove bench is preferably supported on two legs and has a clean-out door, preferably disposed at one end of the stove bench. A damper is disposed at the outlet from the structure for controlling the gases passed through the stove bench.

In an alternate embodiment of the stove bench there is further included an insulated bypass duct disposed beneath the first, heat-conducting duct. Control means are associated with the bypass duct so that hot exhaust gases from a furnace which may operate all year are bypassed around the heat-conducting duct in warm weather when space heating is not desired.

10 Claims, 6 Drawing Figures

STOVE BENCH

BACKGROUND OF THE INVENTION

The present invention relates to a Swiss stove bench, which in the past has comprised a horizontal structure of brick or masonry, defining a flue or duct having an inlet at one end connecting from a stove or furnace, and an outlet at the other end connecting to a vertical chimney.

The conventional stove bench may be constructed with either a single flue or two flues, spaced one above the other with warming compartments between the two flues. The top of the bench is typically provided with a soapstone layer or the like, and a board may be placed on top of the soapstone to form a seat. The conventional stove bench does not have a damper, and thus allows stove gases to be convected up the chimney, essentially as rapidly as the air inlet to the stove or furnace permits. Also, on windy days, the exhaust gases may pass quite quickly through the stove bench, not permitting sufficient time for the stove bench to absorb the heat, thereby wasting energy which simply escapes through the chimney.

Accordingly, one object of the present invention is to provide a stove bench with a control damper for controlling the exhaust gases through the stove bench. This damper not only controls the heat conducted through the bench, but also inherently controls the heat that is permitted to escape from the furnace or stove. This conserves energy by regulating the draw of the stove or furnace to maintain an efficient combustion temperature. By slowing the passage of the hot gases through the bench, these gases are then able to conduct more efficiently through the bench to the seating surface.

The conventional stove bench is constructed substantially entirely of bricks, masonry, or the like. This is a disadvantage, firstly because it requires a skilled workman. Secondly, even with a skilled workman, over a long period of time cracks may develop, resulting in dangerous carbon monoxide leaks or the escape of sparks.

Accordingly, another object of this invention is to provide a stove bench wherein the duct for the passage of gases is defined by a sheet metal liner which may easily and safely be assembled and covered with tile by an average homeowner with little or no masonry experience. Further, even if the metal liner is covered with bricks, after a long period of time there should be no leakage from the duct because of the use of this rugged metal liner.

A further object of the present invention is to provide an improved stove bench, which may be constructed with an aesthetically appealing appearance, which is quite comfortable and which may be used for many different purposes.

Still another object of the present invention is to provide an improve stove bench, that is of simple construction and that can be constructed inexpensively, that is long-lasting, and that requires very little maintenance.

SUMMARY OF THE INVENTION

To accomplish the foregoing and other objects of the invention, there is provided a stove bench, including an elongated hollow duct structure formed as a bench, having an inlet for receiving hot exhaust gases from a stove or furnace, and an outlet for the exhaust of the gases to a chimney or the like. A manual or automatic damper, preferably disposed at the outlet of the stove bench, controls the air flow through the bench.

The hollow duct structure comprises a sheet metal liner forming the duct which may be finished on its exterior surface with a covering of tile or brick. The stove bench is preferably elevated above the floor by means of legs which may also be constructed or brick or other material. The hollow structure is preferably of elongated shape having a clean-out door disposed at one end, so that the walls of the passage may be scraped clean of soot with a hoe-like instrument.

The air inlet to the hollow structure is preferably through a bottom wall defining the structure, while the air outlet extends from the hollow structure at least as high as a midpoint of one of the side walls defining the structure. The damper of the present invention in the disclosed embodiment is arranged at the outlet connecting from the stove bench to the chimney. However, in an alternate embodiment, the damper may be provide at other locations in the stove bench, or even at the inlet to the stove bench. The damper is preferably manually adjusted, although it may also be operated automatically, and may be set to a position that provides sufficient warming at the bench and also optimizes the efficiency of the stove or furnace by limiting the exhaust through the stove bench.

In an alternate embodiment of the invention, the stove bench is constructed in a similar manner to the preferred embodiment discussed above, but has in addition a bypass duct or passage. In the alternate embodiment, the stove bench is connected as before between a heat source, such as a stove or furnace, and an exhaust means such as a chimney or venting system. In the disclosed alternate embodiment, a hollow structure comprises a dividing wall, sectioning the structure into the heating duct and a bypass duct. The heating duct for conducting heat to the top surface of the bench is disposed above the bypass duct and has an inlet and an outlet port connecting through the dividing wall, with the bypass duct. Flow control means are associated with these ports to keep the two ports simultaneously open or closed. In their open position, gas flow is permitted through both the heating duct and the bypass duct. In warm weather, when heating of the surface of the stove bench is not desired, but the furnace may be still operating to, for example, heat water, the ports are closed and all exhaust gases are shunted through the insulated bypass duct directly to the chimney. The bypass duct is preferably insulated by a one-inch layer of asbestos, preferably glued to the metal liner and divider wall by an asbestos cement. In an alternate embodiment, other types of insulation may also be used, such as some types of synthetic insulation. In this alternate embodiment, preferably each duct is equipped with a clean-out door at the same end of the structure.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
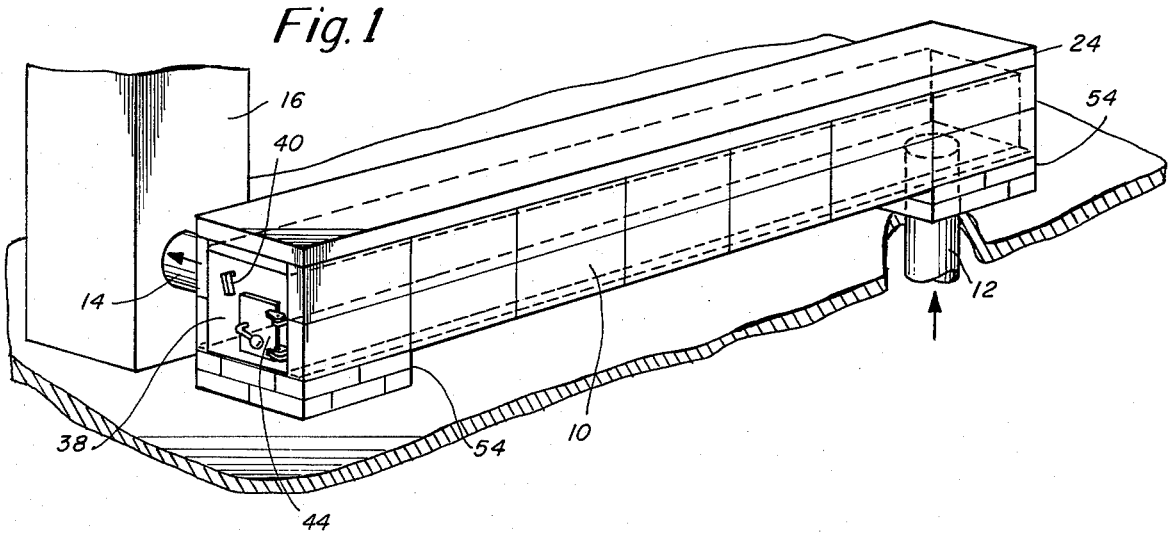
FIG. 1 is a perspective view of a preferred embodiment of the present invention, showing an inlet connection from the heat source and an outlet connection to the chimney.
Figure 2:
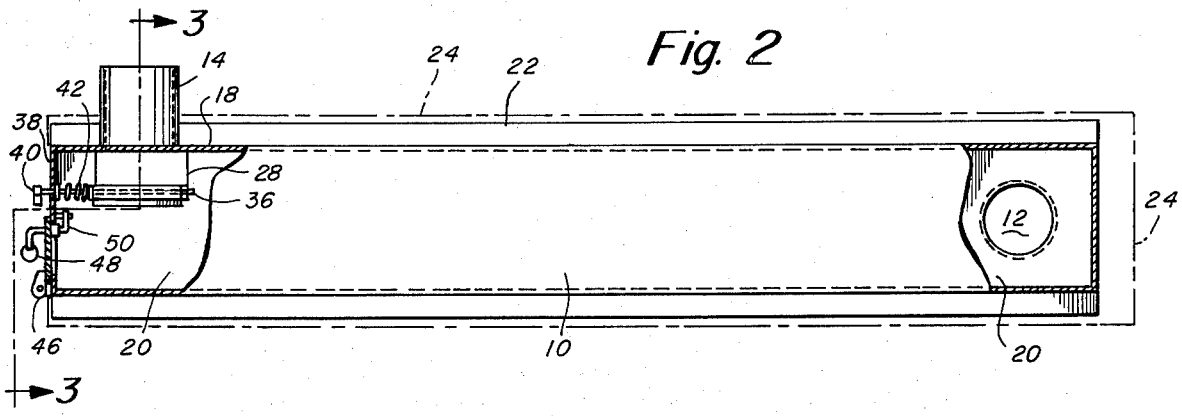
FIG. 2 is a top view of the stove bench of FIG. 1, partially cut away at both ends.
Figure 3:
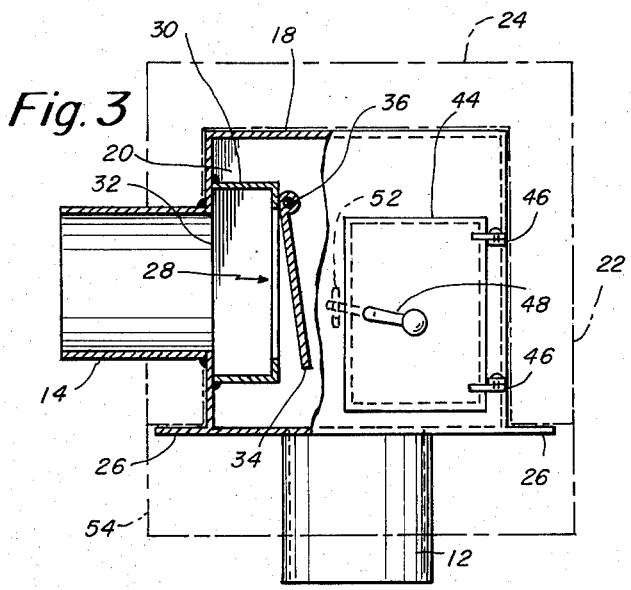
FIG. 3 is a partial cross-sectional view, along line 3—3 of FIG. 2 showing details of the damper and clean-out door construction.
Figure 4:
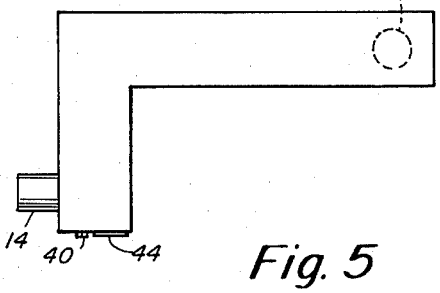
FIGS. 4 and 5 are schematic top views of two alternate embodiments of the present invention.
Figure 5:
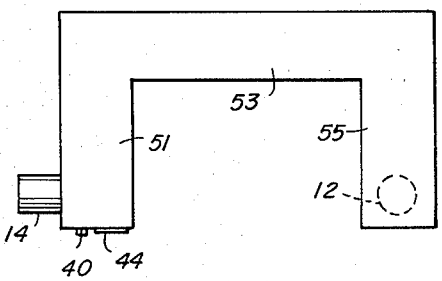
Figure 6:
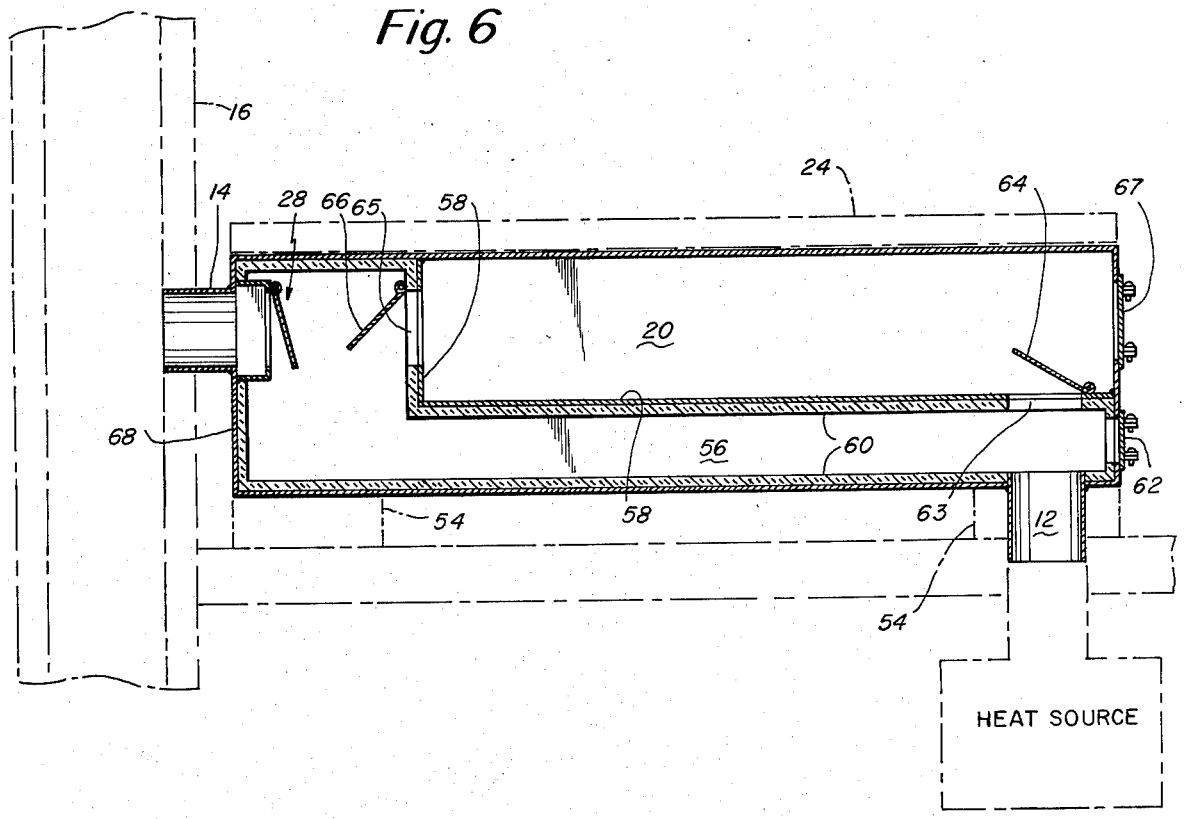
FIG. 6 is a vertical cross-sectional view of an alternate embodiment of the invention employing a warm-weather bypass duct.

The preferred embodiment of the present invention is shown in FIGS. 1–3. FIGS. 4 and 5 are schematic diagrams of alternate shapes of the stove bench of this invention. FIG. 6 shows an alternate embodiment of the invention employing a warm-weather bypass duct, described in more detail hereinafter.

In FIGS. 1–3 the stove bench 10, has connected thereto an air or gas inlet 12 coupled from a stove or furnace (not shown) and an air or gas outlet 14 which couples to chimney 16. The inlet 12 and the outlet 14 may each comprise sections of conventional stove pipe. The stove bench itself is comprised of an elongated metal liner 18 which extends the length of the stove bench having a square cross-sectional shape as depicted in FIG. 3. This liner 18 is preferably constructed of sheet metal which may be bolted or welded together to form the heating duct 20. Alghough the liner 18 is shown with a square cross-section, it may also be constructed in other shapes. The liner 18 is covered with a masonry outer facing 22 which may be of brick or tile.

FIG. 3 shows the tile facing 22 totally surrounding the liner 18. The liner 18 is provided with bottom flanges 26 which rest on either end on the legs 54 which are shown in FIG. 1 as also being constructed of brick.

FIG. 2 shows a top soapstone cover 24 which may form a seating surface or sleeping surface. This soapstone cover 24 is disposed over a top facing of masonry.

A damper assembly 28 disposed at one end of the outlet pipe 14 is most clearly depicted in FIGS. 2 and 3. The damper assembly 28 includes a metallic box 30 having a round or square opening 32 which may be covered by a plate-like damper 34 hinged at its top end from a hinge pin 36. The damper is hinged from a top edge of the box 30 adjacent to the opening 32. The pin 36 is longer than the width of the damper plate 34 and thus extends from the damper plate 34 through an end wall 38 of the stove bench. An adjusting handle 40 is provided, fixedly secured to the outer extending end of the hinge pin for controlling the position of the damper plate 34 so that it can be opened to different positions. The pin 36 and the plate 34 rotate together to provide this type of operation and are suitably also hinged of course to the box 30. In order to maintain the damper in a fixed position, a spring 42 is provided as depicted in FIG. 2. This spring 42 extends about the hinge pin between the wall 38 and the damper plate 34 resting on the inner surface of the wall 38 and at the other end against the corner of the damper plate 34.

Alternatively, the damper plate 34 may be controlled by a commercially available automatic mechanism which operates to substantially close the damper whenever the furnace burner shuts off.

A clean-out door 44 is provided in the end wall 38. The door 44 is supported by hinges 46 from the wall 38 and is provided with a rotatable handle 48. The handle 48 has on its inner end a tongue 50 which engages with a latch 52 so as to tighten as handle 48 is turned counterclockwise as viewed in FIG. 3. Access is easily provided to the duct 20 through the door 44 by opening the door with the use of the handle 48.

The stove bench shown in FIGS. 1–3 can be constructed quite easily. Once the desired area in the room has been selected, the masonry legs 54 may be laid the proper spaced distance. Although two legs are shown, additional legs could be provided for supporting the metal liner. After the legs are in place, the metal liner may be assembled by bolting or welding and placed upon the legs 54. The inlet and outlet pipes may then be connected to accomodating apertures in the liner. Thereafter, the tile or masonry facing 22 is laid about the metal liner 18 except, of course, where the pipes 12 and 14 project from the liner. The soapstone cover 24 may be at that time placed on top of the bench. Also, a further wood plank may be provided over the top of the soapstone or in place of the soapstone cover.

FIG. 4 shows schematically a slightly different embodiment of the invention in that the basic construction of the stove bench is in an L-shape having the inlet at one end of one leg of the bench, and having the outlet 14 at the end of another leg of the bench. In this embodiment is also provided the damper control knob 40 and the clean-out door 44 as depicted in FIG. 4.

FIG. 5 shows another type of bench including sections 51, 53 and 55. The inlet pipe 12 in this embodiment connects at one end of section 55 while the outlet pipe 14 connects at an end of the section 51. The control handle 40 and clean-out door 44 are provided in this embodiment at the end of section 51 adjacent to the outlet pipe 14. Also, additional cleanout doors could be provided at other sections. In this embodiment, heat conduction through to the surface may be provided along only section 53 or along section 53 and also along sections 51 and 55.

In the alternate embodiment shown in FIG. 6, an insulated warm-weather bypass duct 56 is provided below heating duct 20. The bypass duct and the heating duct are defined principally by the dividing wall 58 which is also provided with ports 63 and 65. The port 63 is an inlet port to the duct 20 while the port 65 is an outlet port. The ports 63 and 65 have associated therewith flow control valves 54 and 56 respectively. These valves may be dampers like the damper shown in FIG. 3 or may be other automatic means for opening and closing the ports 63 and 65. The valves 64 and 66 are operated in sequence so that both valves are either opened or both are closed. If manual means are used to operate the valves 64 and 66, then linkages or pins associated therewith and not shown in FIG. 6 may extend through the walls of the structure being provided with external handles or controlling each of the valves.

The bypass duct 56 is preferably insulated so that when all of the exhaust gases are passing through that duct only, there will not be any substantial heat generated into the heating duct 20. For this purpose, sheets of asbestos or other insulating material 60 are cemented to the interior walls of duct 56. As depicted in FIG. 6, the lower duct is provided with a clean-out door 62 while the heating duct 20 is provided with a separate clean-out door 67. The clean-out doors are disposed at the right end of the structure rather than the left end as depicted because the stove bench in FIG. 6 has its end facing the chimney.

In the position shown in FIG. 6, valves 64 and 66 are both controlled to be open. This mode of operation is used in colder weather when the stove bench is to be used. The exhaust from the inlet pipe 12 passes through both ducts 20 and 56 causing a heating of the top surface of the stove bench. Although some of the heat is by-passed through the duct 56 there is still usually sufficient heat in the duct 20 to cause suitable heating. In the warmer weather when the stove bench does not need to have heat generated therefrom the valves 64 and 66 are closed thereby restricting all flow through the duct 56. With this duct 56 also being insulated there should be little or no heat conducted to the top heating surface of the stove bench.

FIG. 6 also shows the outlet pipe 14 and the damper assembly 28. The damper assembly 28 may be substantially the same construction as shown in FIG. 3 and disposed adjacent to the outlet pipe 14.

From the foregoing description those skilled in the art will appreciate that the improvement of the present invention avoids the waste of energy inherent in the prior art structures and reduces the skill required for construction of stove benches. Further, an alternate embodiment of the invention is particularly adapted for use with heat sources that burn all year.

From the foregoing description those skilled in the art will appreciate that numerous modifications may be made in this invention without departing from its spirit and scope. Therefore, it is not intended to limit the scope of this invention to the embodiments illustrated and described. Rather, it is intended that the scope of this invention be determined by the appended claims and their equivalents.

What is claimed is:

1. A stove bench comprising a hollow elongated structure having walls defining a duct, having an elongated top horizontal seating surface, and having means defining an inlet and outlet, said inlet and outlet being spaced from one another along the elongated duct whereby air or gas flow to the inlet passes through the duct to the outlet, and flow control means associated with said structure including means for varying flow through the duct, said hollow structure also having a substantially horizontal wall sectioning the duct into an upper primary heat duct for supplying heat to the seating surface and a lower bypass duct that is disposed on the opposite side of the primary heat duct to the seating surface, said upper and lower ducts both extending substantially in parallel and along the bench seating surface, said flow control means including damper means associated with one of said inlet and outlet and means associated with said upper and lower ducts adapted to be either open or closed.

2. A stove bench as set forth in claim 1 wherein said by-pass duct includes insulation means and wherein at least the upper surface of the primary duct is absent any insulation.

3. A bench as set forth in claim 1 wherein said structure walls include an end wall adjacent one of said inlet and outlet, said end wall having a cleanout door therein providing access to the duct, said damper means comprising a box-like structure supported within said duct having an open side leading into the outlet and an opposite open side covered by the damper means, said damper means including means for pivotally supporting the damper means to open and close the opposite open side of the box-like structure under control of the manually operated means.

4. A stove bench as set forth in claim 1 wherein said flow control means includes automatic damper means for automatically closing whenever the gas flow to said hollow structure is turned off.

5. A stove bench as set forth in claim 1 wherein said hollow structure includes a sheet metal liner and a masonry-like outer cover.

6. A stove bench as described in claim 1 wherein said hollow structure is L-shaped.

7. A stove bench as described in claim 1 wherein said hollow structure is U-shaped.

8. A stove bench as set forth in claim 1 wherein said bypass duct includes insulation means and there is further provided a pair of ports between said heating duct and said bypass duct.

9. A stove bench as set forth in claim 8 wherein the flow control means associated with the upper and lower ducts includes damper means associated with each port, when both said damper means are open flow being provided through the upper duct and when both are closed flow being bypassed to said lower duct.

10. A stove bench as set forth in claim 8 wherein said insulation means includes an asbestos material.

* * * * *